US010240782B1

(12) United States Patent
Powell

(10) Patent No.: US 10,240,782 B1
(45) Date of Patent: Mar. 26, 2019

(54) MOBILE TRASH INCINERATION APPARATUS

(71) Applicant: Randy T. Powell, Marietta, TX (US)

(72) Inventor: Randy T. Powell, Marietta, TX (US)

( * ) Notice: Subject to any disclaimer, the term of this patent is extended or adjusted under 35 U.S.C. 154(b) by 330 days.

(21) Appl. No.: 15/298,169

(22) Filed: Oct. 19, 2016

Related U.S. Application Data

(60) Provisional application No. 62/243,648, filed on Oct. 19, 2015.

(51) Int. Cl.
*F23G 5/40* (2006.01)
*F23J 1/00* (2006.01)

(52) U.S. Cl.
CPC *F23G 5/40* (2013.01); *F23J 1/00* (2013.01); *F23G 2203/601* (2013.01)

(58) Field of Classification Search
CPC ... F23G 5/40; F23G 2203/60; F23G 2203/601
See application file for complete search history.

(56) References Cited

U.S. PATENT DOCUMENTS 1,891,069 A * 12/1932 Suciu ..... F23G 5/40 110/217
3,307,507 A 3/1967 Boyd et al.
3,503,347 A * 3/1970 Wallace ..... F23G 5/10 110/191
3,785,303 A 1/1974 Hopkins
4,353,351 A * 10/1982 Cagle ..... F24B 7/00 126/193
4,627,365 A 12/1986 Tseng
4,688,494 A * 8/1987 Domnitch ..... F23G 5/40 110/240
5,727,481 A * 3/1998 Voorhees ..... F23G 5/40 110/193
6,945,180 B1 9/2005 Khymych
2007/0144412 A1* 6/2007 O'Connor ..... F23G 5/40 110/241
2012/0318255 A1* 12/2012 Brown ..... F23B 20/00 126/25 R

* cited by examiner

*Primary Examiner* — David J Laux

(57) ABSTRACT

A mobile trash incineration apparatus that can receive a large amount of trash while fully containing the incineration process. In particular, the apparatus can include a container or housing having one or more support bars located at the lower region of the container, and a meshed screen supported by the one or more support bars. Further, the container can include a first door and second door secured to the one or more support bars, wherein the first and second door are pivotable about an axis. In addition, a first latch can be secured to the first door, and a second latch secured to the second door, wherein the first door and second door can be configured to release debris or ashes from the container after an incineration process.

8 Claims, 4 Drawing Sheets

MOBILE TRASH INCINERATION APPARATUS

CROSS-REFERENCE TO RELATED APPLICATION

This application claims the benefit of U.S. Provisional Application No. 62/243,648 filed on Oct. 19, 2015, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Generally, incineration has been determined to be the best way to deal with garbage and trash. The conventional method of eliminating garbage involves collecting garbage with garbage trucks which run on streets and alleys every day collecting and transporting garbage to the garbage dump for incinerating. The increasing high costs of this method has become a heavy burden to governments. In addition, many rural areas do no have garbage service and if they do it can be very cumbersome for a home owner to carry several loads of trash across a large lot of land.

Many different types of waste incinerators and furnaces have been proposed in the past. For the most part, these are the large-scale industrial waste treating plants, wherein garbage is delivered to these sites for burning and further disposal. These devices require supply of fuel and exhaust treatment facilities to prevent polluting the atmosphere with escaping burning gases.

Hence, what is needed is a safe and effective method of incinerating trash that is simple to use, mobile, portable, and fully contains the trash incineration process.

BRIEF SUMMARY

In one aspect of the present disclosure described herein, a mobile trash incineration apparatus is disclosed that can receive a large amount of trash while fully containing the incineration process and not require a supply of fuel while safely incinerating its contents within. In particular, the trash incineration apparatus can include a housing having one or more wheels coupled thereto, a lower floor region configured to receive burned ashes, the lower floor region further comprising a screen for support received trash, the lower floor region further having a pivoting door configured to release the received burned ashes, and wherein the pivoting door is further operated by a latch mechanism.

In another aspect of the disclosure described herein, a mobile trash incineration apparatus is disclosed having a container with one or more wheels secured thereto. In addition, the apparatus can include one or more support bars located at the lower region of the container, and a meshed screen supported by the one or more support bars. Further, a first door and second door secured to the one or more support bars, wherein the first and second door are pivotable about an axis. In addition, a first latch can be secured to the first door, and a second latch secured to the second door.

Here, wherein the first door and second door can be configured to release debris or ashes from the container after incineration of the trash.

Further, the container can include a hinged lid, and a third door. In addition, the container can include a trailer hitch. Here, the first latch and second latch can each include a guide. Further, the first latch and second latch can be of a vertical elongated bars having a T-shaped or L-shaped handle. In addition, a chain link can be connected to the distal end of the first latch and second latch, wherein the chain link further connects to the first and second doors. In addition, the first door and second door can be hinged to or via same support bar. Further, wherein the first door and second door can pivot from the middle region of the container. In addition, the container can be made of fire-rated steel configured to withstand temperatures up to 2,000 deg. Fahrenheit.

In another aspect of the disclosure described herein, a mobile trash incineration apparatus is disclosed having a container with a closable cover. The apparatus can further include one or more support bars located at the bottom of the container. In addition, a meshed screen can be supported by the one or more support bars. Further, a tray can be secured to the one or more support bars, wherein the tray is pivotable about an axis configured to release collected debris or ashes. In addition, a latch can be secured to the tray via a link, wherein the latch the latch is configured to open or release the tray.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

Figure 1:
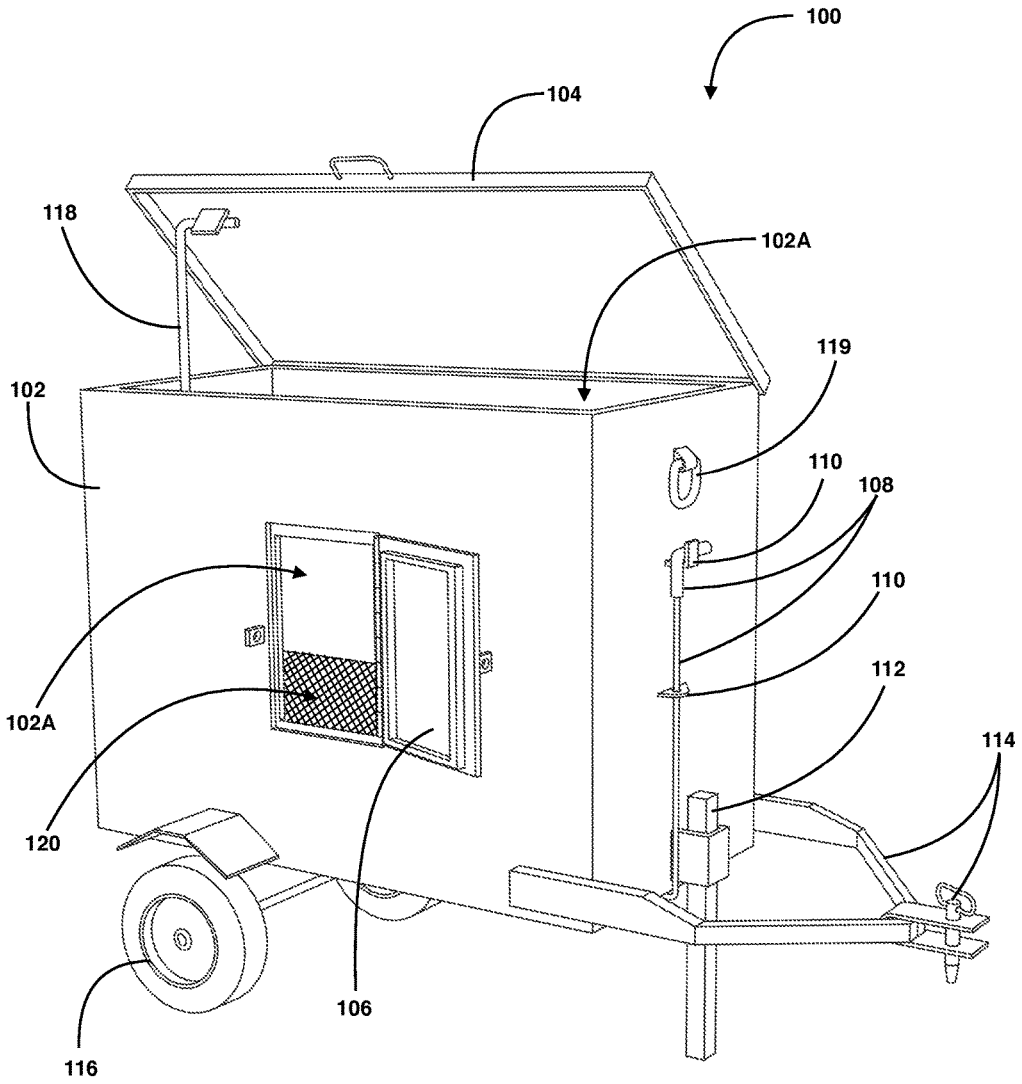
FIG. 1 illustrates a perspective front view of one non-limiting embodiment of a mobile trash incineration apparatus of the disclosure described herein.
Figure 2:
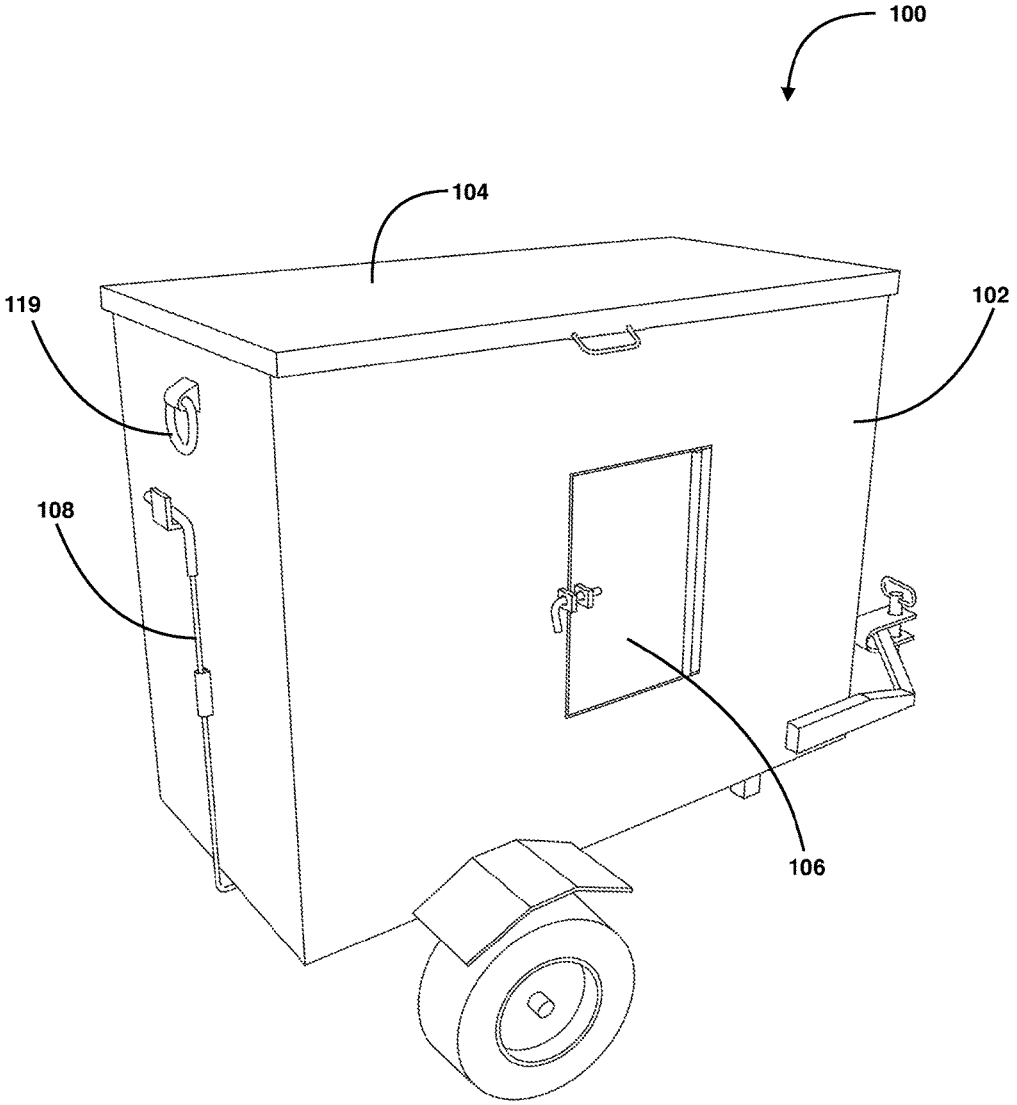
FIG. 2 illustrates a perspective rear view of the mobile trash incineration apparatus of the disclosure described herein.

Referring now to FIGS. 1-4, trash incineration apparatus 100 is shown having a container or housing 102 with an interior space compartment 102A for receiving and holding various types of trash, garbage, or disposable items. Here, it is contemplated within the scope of the disclosure herein that the volumetric space of the compartment 102A may be of any volume, such as from 5 gallons up to and including 1,000 gallons or 10 cubic inches up to and including 10000 cubic inches. Apparatus 100 is further shown having hinged lid 104 for enclosing housing 102, wherein lid 104 allows apparatus 100 to substantially fully contain the trash and the fire/smoke generated from the incineration. In addition, a stand or support bar 118 can keep lid 104 open during loading of trash into compartment 102A and on top of screen 120. In the current embodiment, smoke may either by fully contained or be allowed to escape the compartment either through various apertures within housing 102, from around the outer periphery of the lid 104 (when closed), or apertures within the lid 104. In addition, apparatus 100 can also include a pair of wheels 116 that allow apparatus to be mobile and portable. Further, apparatus 100 may also be fitted with a trailer extension and hitch 114 for allowing apparatus 100 to be carried by a vehicle or a user. In addition, extension and hitch 114 may also be stowed away by a pivoting action. Further, a securable extension support leg 112 allows the apparatus to remain secured and stable. In addition, apparatus 100 may also include hooks 119 on each side for securing apparatus 100 via locks, rope, or chains. Here, FIG. 2 illustrates the apparatus with its lid and doors closed and ready for a trash incineration session.

Still referring to FIGS. 1-4, apparatus 100 further includes a hinged door 106, which allows a user to either place trash within or remove trash from apparatus 100. Further, door 106 may also have a locking mechanism. In addition, door 106 will allow a user to place fire starting/initiating material within compartment 102A, such as matches, paper, sparks, lighter, fuel, flammable items, and the like. Further, each side of apparatus 100 includes a latch handle 108 for releasing or securing a pair of tray doors 126 located at the bottom of the apparatus.

Figure 3A:
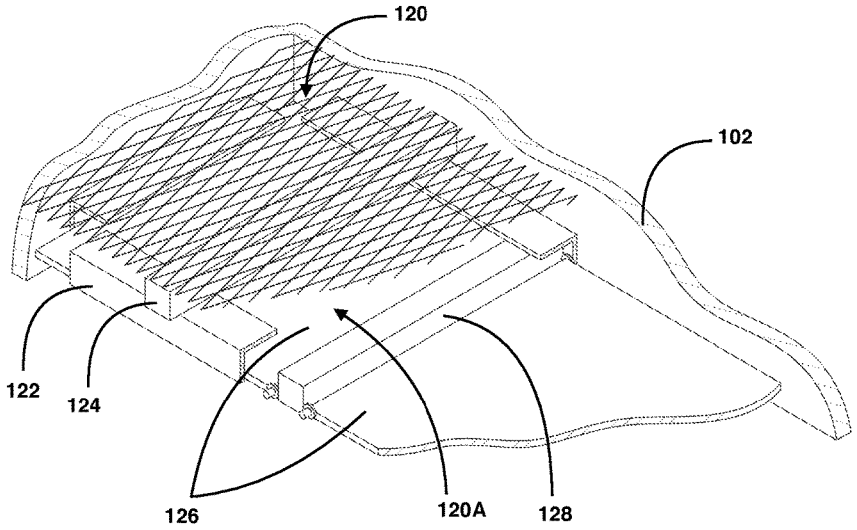
FIGS. 3A-3B illustrate perspective partial interior views of the mobile trash incineration apparatus of the disclosure described herein.
Figure 3B:
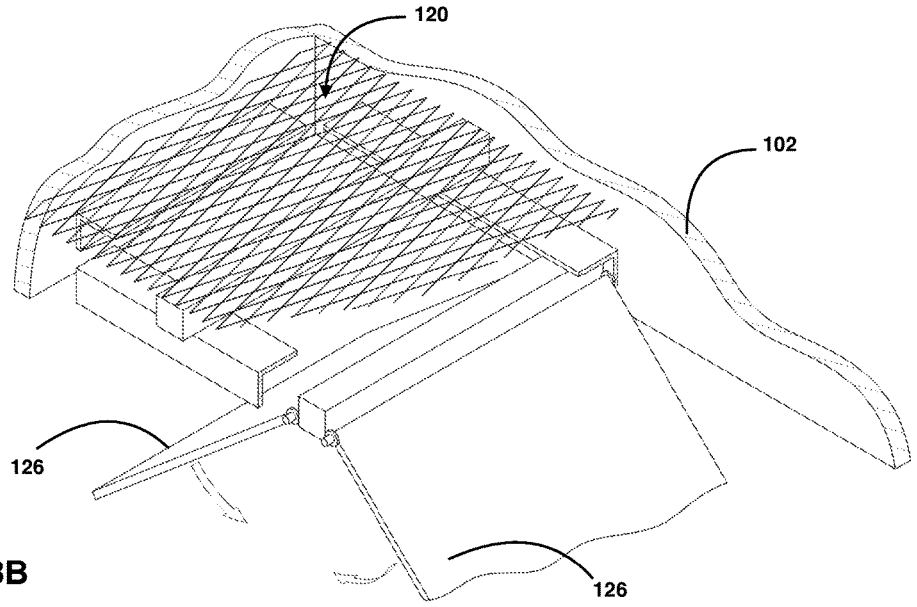

Referring to FIGS. 3A-3B, the lower region of interior compartment area 102A is shown in a partial cut-away illustration. Here, the lower area can include a meshed flexible screen 120 that allows the trash and contents to be suspended while allowing the burned ashes to fall therethrough. In addition, a pair of cross bars 122 and 124 are provided for structural support. More specifically, screen 120 may be configured to rest on cross bars 122, 124, and 128. In addition, screen 120 may be removed to be cleaned and/or replaced. Here, panels or tray doors 126 can articulate, open/close, and pivot about a hinge on support bar 128 in order to release and dump burned collected dry ashes after incineration has completed. More specifically, since support bars 122, 124, and 128 keep screen 120 suspended, a cavity or opening 120A is created between the bottom of screen 120 and top surface of trays 126 for collecting burned ashes during incineration on the top surface of trays 126. Here, FIGS. 3A-3B illustrate a partial cut-away of the interior of the compartment 102A for illustration purposes only, however, in full view, screen 120 extends the entire length of the bottom region of the apparatus.

Figure 4:
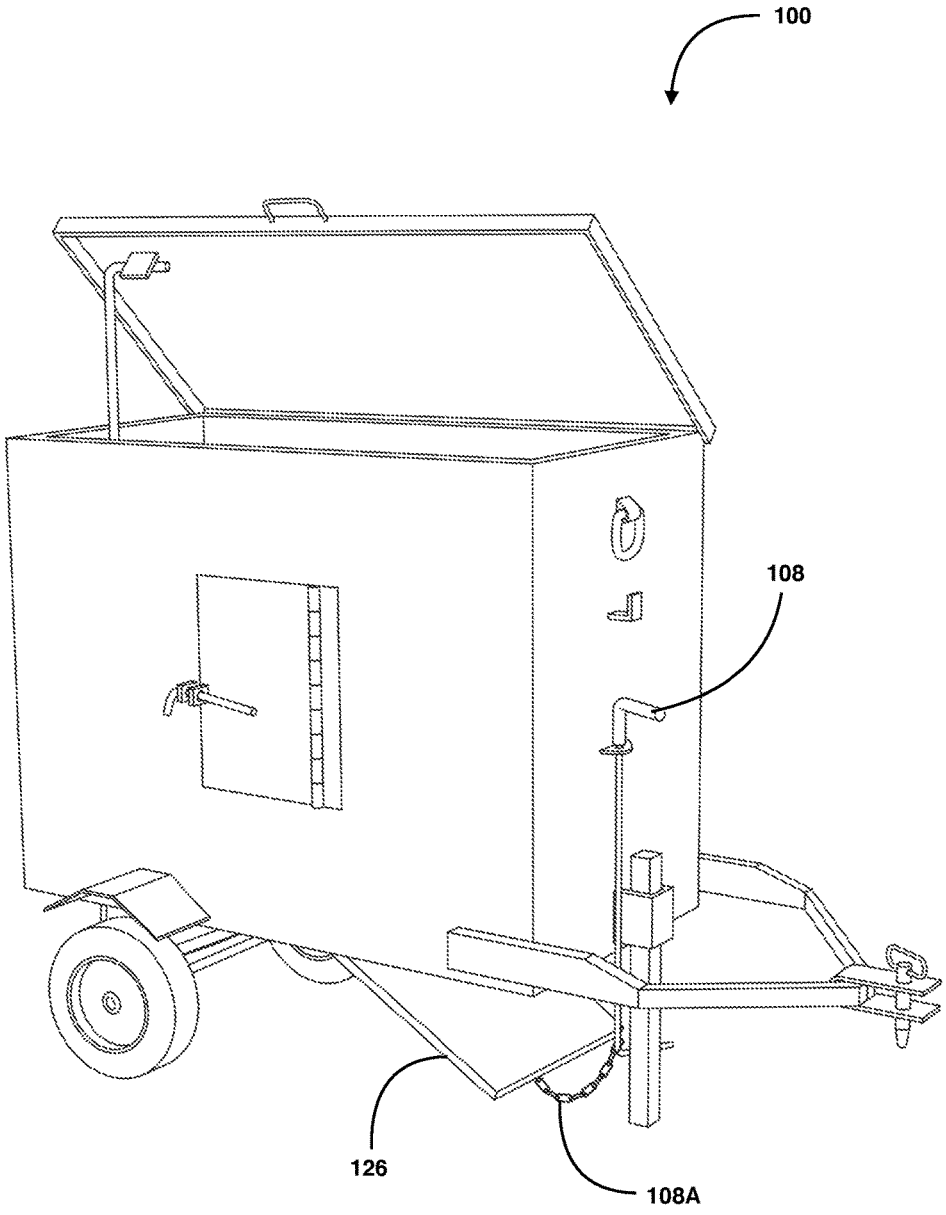
FIG. 4 illustrates another perspective front view of the mobile trash incineration apparatus of the disclosure described herein.

Referring to FIGS. 1-4, each vertical latch handle 108 is secured to each tray door 126 via support chain link 108A. Further, each latch 108 can be secured by guide brackets 110 that guides latch handle 108 in a vertical manner, such as raised up to hold latch 108 via a hook and close tray doors 126, or released from the hook and guided downwards to open tray doors 126, as shown in FIG. 3B and FIG. 4.

Here, it is contemplated within the scope of the disclosure that the trash incineration apparatus 100 may be of welded steel, galvanized steel, and metal that is fire-rated to withstand temperatures up to 2,000 deg. F. and can be further made of any thickness and gauge. For example, any type of material or liquid (including highly flammable) may be burned within apparatus 100 and wherein the material is fully contained within apparatus during incineration, thereby preventing any flames, sparks, burning embers, or harmful/dangerous gases from escaping apparatus 100 during an incineration session.

Since many possible embodiments may be made of the invention without departing from the scope thereof, it is to be understood that all matters herein set forth or shown in the accompanying drawings are to be interpreted as illustrative, and not in a limiting sense. While specific embodiments have been shown and discussed, various modifications may of course be made, and the disclosure described herein is not limited to the specific forms or arrangement of parts or method of assembly described herein, except insofar as such limitations are included in the following claims. Further, it will be understood that certain features and sub-combinations are of utility and may be employed without reference to other features and sub-combinations.

What is claimed is:

1. A mobile trash incineration apparatus, comprising:

a container having one or more wheels secured thereto;

one or more support bars located at the lower region of the container;

a meshed screen supported by the one or more support bars;

a first door and second door secured to the one or more support bars, wherein the first and second door are pivotable about an axis;

a first latch secured to the first door, and a second latch secured to the second door;

wherein the first door and second door are configured to release debris or ashes from the container wherein the first door and the second door pivot from approximately the middle region of the container; and wherein the first door and the second door open in opposite directions with respect to each other.

2. The apparatus of claim 1, wherein the container further comprises a hinged lid.

3. The apparatus of claim 1, wherein the container further comprises a third door.

4. The apparatus of claim 1, wherein the container further comprises a trailer hitch.

5. The apparatus of claim 1, wherein the first latch and second latch each comprise a guide.

6. The apparatus of claim 1, wherein the first latch and second latch are comprised of a vertical elongated bar.

7. The apparatus of claim 1, wherein the first door and second door are hinged to the same support bar.

8. The apparatus of claim 1, wherein the container is made of fire-rated steel configured to withstand temperatures up to 2,000 deg. Fahrenheit.

* * * * *